United States Patent [19]

Marentic

[11] Patent Number: 4,492,957

[45] Date of Patent: Jan. 8, 1985

[54] PLASMA DISPLAY PANEL DRIVE ELECTRONICS IMPROVEMENT

[75] Inventor: Michael J. Marentic, Orange, Calif.

[73] Assignee: Interstate Electronics Corporation, Anaheim, Calif.

[21] Appl. No.: 272,885

[22] Filed: Jun. 12, 1981

[51] Int. Cl.[3] ..... G09G 3/28

[52] U.S. Cl. ..... 340/777; 340/805

[58] Field of Search ..... 340/777, 805, 776, 771; 315/169.1, 169.4

[56] References Cited

U.S. PATENT DOCUMENTS

| | | | |
|---|---|---|---|
| 3,706,892 | 12/1972 | O'Brien | 340/776 |
| 3,846,646 | 11/1974 | Peters | 340/776 |
| 4,063,131 | 12/1977 | Miller | 340/776 |
| 4,189,729 | 2/1980 | Baker et al. | 340/777 |
| 4,414,544 | 11/1983 | Suste | 340/805 |
| 4,415,892 | 11/1983 | Marentic | 340/805 |

*Primary Examiner*—Marshall M. Curtis

*Attorney, Agent, or Firm*—Knobbe, Martens, Olson & Bear

[57] ABSTRACT

Voltage pulser circuits are utilized to selectively, alternately supply high voltage to, or ground the high voltage input of plasma panel driver chips. High voltage is supplied to a driver chip only when the driver chip must perform an addressing pulse. The grounding operation, which is induced by shorting the high voltage input of a driver chip to the ground input of the chip, greatly reduces the amount of power which must be dissipated in the driver chip. The use of the voltage pulser circuit also allows full slew rate control of the output pulse which the driver chips supply to the plasma panel.

16 Claims, 12 Drawing Figures

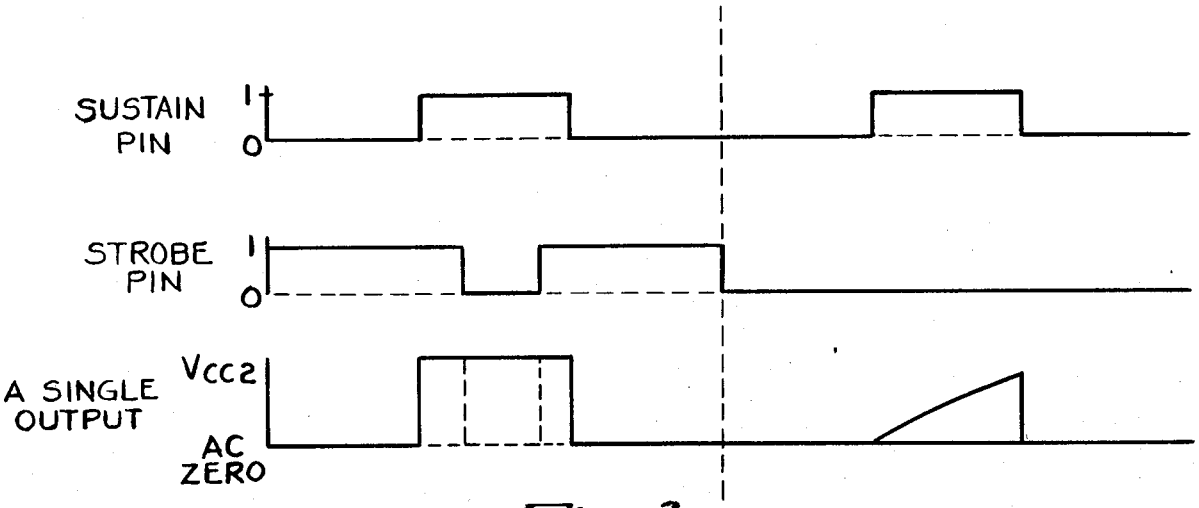
Fig. 3
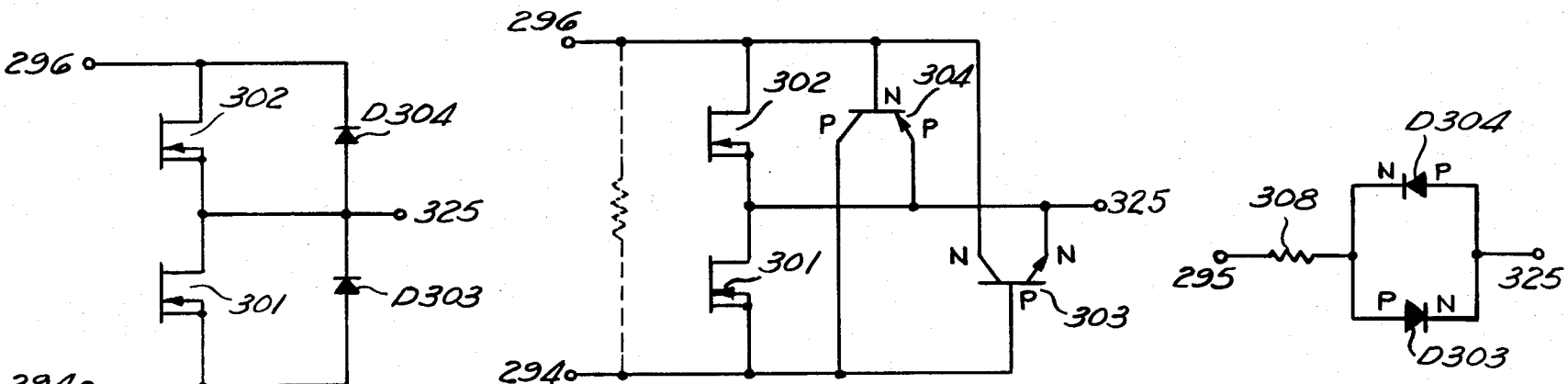
Fig. 8 A
Fig. 8 B
Fig. 8 C

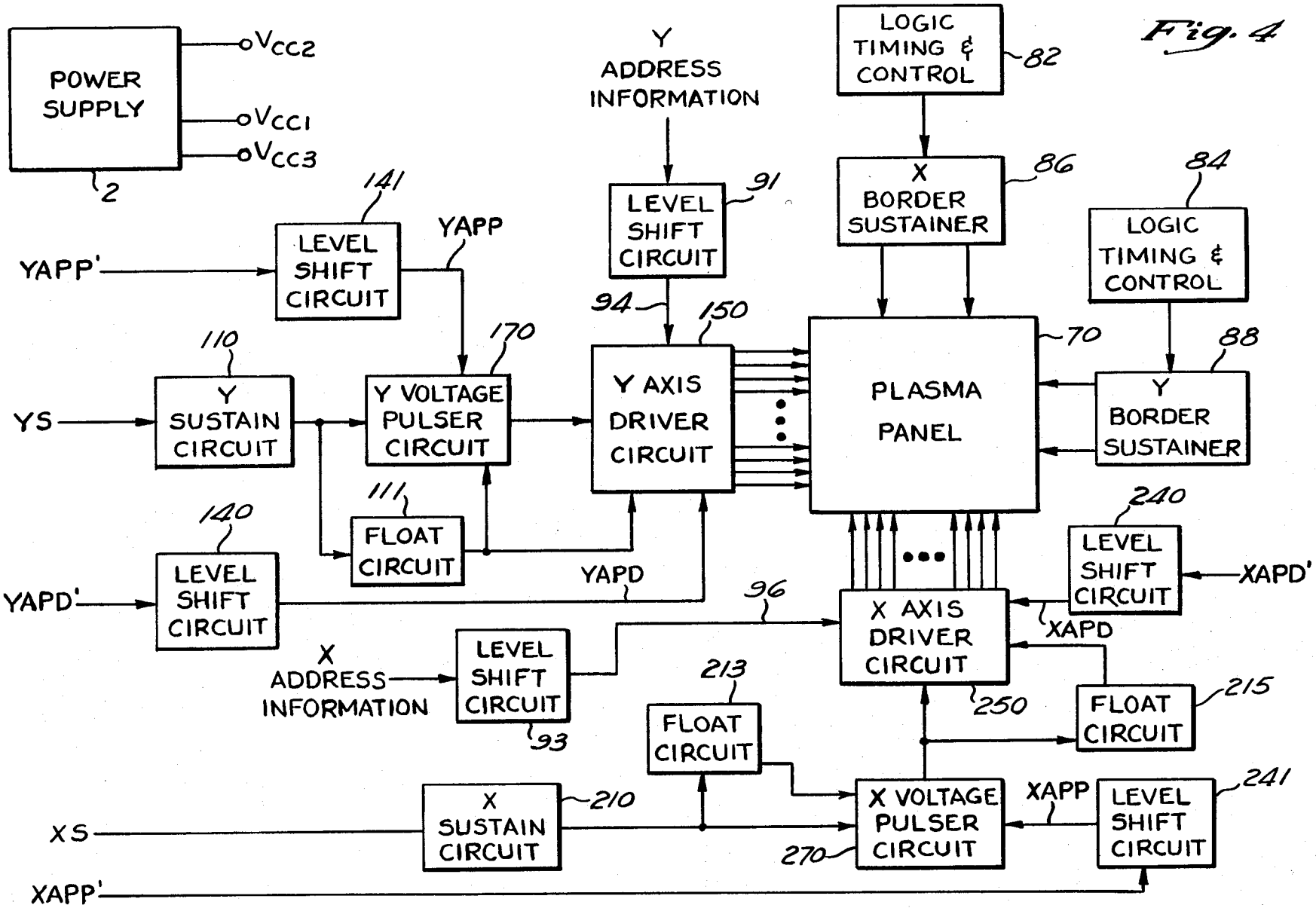
Fig. 4
LOGIC TIMING & CONTROL
82
X BORDER SUSTAINER
86
LOGIC TIMING & CONTROL
84
Y BORDER SUSTAINER
88
PLASMA PANEL
70
LEVEL SHIFT CIRCUIT
240
XAPD'
XAPD
FLOAT CIRCUIT
215
LEVEL SHIFT CIRCUIT
241
XAPP
X AXIS DRIVER CIRCUIT
250
X VOLTAGE PULSER CIRCUIT
270
FLOAT CIRCUIT
213
96
Y ADDRESS INFORMATION
LEVEL SHIFT CIRCUIT
91
Y AXIS DRIVER CIRCUIT
150
94
YAPD
LEVEL SHIFT CIRCUIT
93
X SUSTAIN CIRCUIT
210
Y VOLTAGE PULSER CIRCUIT
170
YAPP
FLOAT CIRCUIT
111
LEVEL SHIFT CIRCUIT
141
X ADDRESS INFORMATION
Y SUSTAIN CIRCUIT
110
LEVEL SHIFT CIRCUIT
140
POWER SUPPLY
2
VCC2
VCC1
VCC3
YAPP'
YS
YAPD'
XS
XAPP'

PLASMA DISPLAY PANEL DRIVE ELECTRONICS IMPROVEMENT

BACKGROUND OF THE INVENTION

Plasma display panels are presently in commercial use as digitally addressable information display devices. The panel itself typically consists of two glass plates with a gas mixture sealed between them. A plurality of X-axis electrodes extend in a mutually parallel array on an interior substrate of one plate, and a plurality of Y-axis electrodes extend in a mutually parallel array on the interior of the other plate. The X-axis electrodes are at a 90° angle to the Y-axis electrodes, thereby forming a plurality of intersections between the X-axis and Y-axis electrodes. A typical commercially available AC plasma panel has 512 X-axis electrodes and 512 Y-axis electrodes, yielding 262,144 intersections or cells.

When a voltage of between 180 and 200 volts is applied across an X-axis electrode and a Y-axis electrode, a discharge in the gas occurs at the cell formed by the electrodes, causing a pulse of light to be emitted at this point. Simultaneously, a charge is collected on the cell walls, which results in the cell being an "on" cell. Once such a discharge has been produced and the cell is turned "on", the collected wall charge acts to continue the discharging when a lesser AC sustain voltage is applied between the electrodes. In an "on" cell, the gas will discharge and the cell will emit a pulse of light at each transition of the applied AC sustain waveform. The sustain voltage, however, is insufficient to initiate a discharge at an X-Y intersection. This phenomenon is known as inherent memory, and was originally disclosed by Baker et al in U.S. Pat. No. 3,499,167, and by Bitzer et al in U.S. Pat. No. 3,959,190. By precisely timing, shaping, and phasing multiple alternating voltage waveforms supplied to X and Y axes electrodes, the generation, sustaining, and erasure of light emitting gas discharges at selected locations on the plasma display panel can be controlled.

The state of the art of drive systems for plasma panels is represented by patent application Ser. No. 412,205, filed Aug. 27, 1982, which is a continuation of patent application Ser. No. 166,579, filed July 7, 1980 (now abandoned), by Joseph T. Suste, describing a Drive System For A Plasma Panel utilizing only three voltage levels, and patent application Ser. No. 258,757, filed Apr. 29, 1981, by Larry M. Weber, describing a MOSFET Sustainer For A Plasma Panel Drive System. These two patents are assigned to the assignee of the present invention, and both of these specifications are hereby incorporated herein by reference.

These systems utilize Texas Instruments integrated circuit driver chips to drive the electrodes of the plasma panel. These chips, each capable of driving 32 electrodes on the panel, are types SN75500 and SN75501. These are the only currently available driver chips, and they have several serious design problems that the manufacturer cannot remedy at this time. The only alternative to using these driver chips is to use a resistor-diode matrix, wherein each electrode is connected to two diodes and a resistor. For 512 lines there are also 16 high voltage pulser circuits and 32 high voltage switch circuits required. In order to drive a 512×512 plasma display panel, the discrete electronics alternative to the Texas Instruments driver chips takes up 650 square inches of printed circuit board. Using the Texas Instruments driver chips, the number of components required is reduced by a factor of 100, and the printed circuit board area required is reduced by a factor of 5. Since assembly and test costs are greatly reduced by using the Texas Instruments drive chips, it is no longer economically feasible to build plasma panel display systems without using the driver chips.

The most significant problem encountered in using the Texas Instruments driver chips is that of dissipating the power consumed in these chips. Power dissipation can be divided into 5 areas: low voltage logic power, quiescent power, level shifting boost power, parasitic power, and notch dissipation power.

Low voltage logic power is the power used to control the logical switching process of the driver chips. This power is not an appreciable cause of excess power dissipation within the driver chips.

Quiescent power is the power consumed by the high voltage switching components within the chip while the chip is turned on but not performing any type of operation. Since the driver chips are being used to switch 100 volts, even a small amount of quiescent current drawn by the chips will result in a fairly large amount of power being dissipated in the chips. The quiescent current for the SN75500 chip is 2 mA, and the quiescent current for an SN75501 driver chip is 3 mA. The quiescent power consumed by the chips is 200 mW and 300 mW, respectively. Since a 512×512 plasma display panel system requires 16 of each of the two types of chips, the quiescent power of the system's driver circuitry will be 8 watts. This power level typically represents 10 to 20% of the entire plasma display panel system power.

Level shifting boost power is the power consumed by the chip when it is being switched between output stages. The chips use a boost current of 2 mA to switch from the low state to the high state. If all of the 32 outputs of the driver chip are to be switched, a 2 mA current will be drawn by a switching transistor in the circuitry of each output at a duty cycle of 2.5%, which results in a time-averaged level of 192 mW of power per chip being consumed when switching at a standard rate of 50 kHz.

The next major power dissipation problem is created by the existence of parasitic transistors in the driver chips. A parasitic transistor is an inadvertently created np or pn junction which is inherent in the forming of a pn or np diode. In order to better understand the problem it is necessary to understand the basic operation of the driver chip switching circuit.

The design of the Texas Instruments driver chips utilizes 32 totem-pole output stages in order to perform the switching operation. A totem-pole is basically two switching transistors connected in series, with their common lead being the output of the circuit. The second switch lead of one transistor is connected to high voltage, and the second switch lead of the second transistor is connected to ground, or low voltage. By ensuring that only one of these transistors is turned on at a time, the output of the circuit can be switched from high voltage to low voltage.

The transistors used in the totem-pole output stages of the Texas Instruments driver chips are N-channel enhancement DMOS (double diffused metal oxide silicon) transistors, which are the key for fabricating high voltage drivers and low voltage control logic on the same chip. The Texas Instruments design utilizes a pair of clamp diodes on the output of the totem-pole to prevent the output level from rising above the high voltage or below the low voltage. When these clamp diodes are fabricated, parasitic bi-polar transistors are formed along with the diodes. These parasitic transistors, inherent in junction isolation IC technology, result from the existence of an additional np or pn junction being formed with the clamp diodes. The clamp diodes are the base-emitter junction of the parasitic transistor, and the additional junction is the base-collector junction. The resulting transistor has its emitter connected to the common output, its base connected to either the high or low voltage, and its collector connected to the other voltage level. This has the effect of placing a 100-volt drop across the base-collector junction of each of these parasitic transistors. Therefore, when the base-emitter junction is forward biased, current will flow between the base and the collector, causing power to dissipate in this junction. While Texas Instruments endeavored to make the parasitic transistor's beta (ratio of collector current to base current) as low as possible, the typical beta of 0.4 which resulted was not low enough to eliminate the parasitic transistor as a power dissipation problem.

When the system performs a switching operation, there is a current spike drawn by the panel of 20 mA. Therefore, a current of 8 mA (0.4×20 mA) will flow through the base-collector junction, resulting in an instantaneous power dissipation of 800 mW for each of the 32 outputs of the chip. The only thing which prevents the chip from immediately self-destructing is the fact that the current spike lasts only 300 nS. For purposes of comparison, the clamping diode portion of the parasitic transistor dissipates only 50 mW of instantaneous power, less than one-tenth that dissipated by the parasitic transistor. The time-averaged parasitic power consumed may be as high as 384 mW per chip.

Another type of power dissipated by the driver chips is notch dissipation power. The term "notch" derives from the level of voltage supplied by the driver chip's totem-pole outputs.

If an oscilliscope is placed across the voltage supplied to the electrode and ground, the trace generated when a voltage pulse is sent to the electrode would initially rise to close to 100 volts, and then, for a fraction of a second, will drop several volts before returning to the 100-volt level. The drop in voltage level, being very short, makes the oscilliscope trace look like it had a notch removed from it; hence, the term voltage notch.

The voltage notch is caused by the high current drawn by the electrodes, which is approximately 20 mA if all 512 cells are being supplied with the voltage pulse. This current causes the transistors in a driver chip totem-pole output to develop a voltage drop which causes less than the 100 volts to be applied to the electrode. The high transistor in the totem-pole of the Texas Instruments chips will develop an 8.5-volt drop, and the low transistor will develop a 2.5-volt drop.

Notch dissipation power is the power dissipated in the switching transistors of the totem-pole, and the large amount of notch dissipation power is caused by the excess voltage drop across the switching transistors. Since the voltage drops are relatively high, a considerable amount of power must be dissipated by the switching transistors. The average power per fully loaded electrode is 1.3 mW, and the power dissipated in these switching transistors due to notch dissipation power may reach a time average level of about 39 mW per driver chip.

The cumulative effect of all of the above power dissipation problems in the integrated circuit chip is that the power dissipated will cause the chip to operate at a fairly high temperature. It has been observed that the temperature rise of the driver chip case is over 75° C. in an ambient environment of 23° C. Since it is generally required that the drive electronics be encased in a sealed unit, the possibility of failure due to power dissipation in the driver chips becomes even greater. It has been found that the operating life of a driver chip in a circuit using the above-described advanced technology is only hours to days.

The next problem present in the Texas Instruments driver chips is an output pulse fall time which is so fast that it generates high instantaneous currents which will cause noise generation, disrupting system performance. Both chips have fall times of 30 to 50 nS. The instantaneous current may be calculated by using the formula $i=c\cdot dv/dt$. The capacitance for a typical 512×512 panel is 3500 pf, the voltage change is 100 V in 50 nS. The instantaneous current is thereby 7 A, a tremendous amount even for a short time. This current will cause a voltage to be induced in nearby interconnecting wires, and this voltage will cause logic errors in the system.

In selecting the rise time and fall time of the voltage pulse which is supplied to the electrodes, there is a compromise involved. If the transition between voltage levels is too slow, the plasma panel display cells, or intersections between X and Y electrodes, will exhibit poor memory and light emitting characteristics. Under normal circumstances, the discharge causing the emission of light pulse and the execution of a write or erase operation occurs at a point on the pulse where the peak voltage level of the pulse has been reached. However, if the transition time is too slow, this discharge will have a tendency to occur during the rising portion of the pulse, before the peak voltage has been reached. The result is a weak discharge causing poor memory and poor light emitting characteristics in the plasma panel system.

In contrast, too fast a transition time will cause noise to be generated in the system, given the relatively high voltage of about 100 volts that is being switched. The Texas Instruments driver chips have fall times of 30 to 50 nS. If an electrode of the plasma panel is charged to 100 volts in 50 nS, the instantaneous current flowing through the charging circuit is approximately 7 amps. Since the physical size of a typical plasma display panel is 1 foot×1 foot, the presence of 512 X-electrodes and 512 Y-electrodes in that area indicates that these electrodes are extremely close together. Interconnecting wires to the plasma panel have been found to have approximately 1 nH of inductance and the extremely high instantaneous current will therefore cause voltage drops of several volts in adjoining wires, which will result in logic errors in the plasma display panel system.

Transition times of between 200 and 400 nS are generally considered ideal. While the rise times of the Texas Instruments driver chips fall within this range, the fall times are much too fast. The result of using the Texas Instruments driver chips is an unacceptably large number of logic errors.

The next problem associated with these driver chips is caused by the voltage notch described above. In addition to being a power dissipation problem, the large voltage notch imposes constraints on the design of the system. The voltage notch, particularly the 8.5 V drop in the high state, cause the voltage applied to the panel to be dropped from the desired 100 V to about 92.5 V, when the selected electrode is being driven to the high state.

This lesser voltage level is very near the absolute minimum required voltage, and any further losses will cause a failure in the operation of the panel. Since no further loss can be tolerated, precise regulation of the power supply, the use of high-precision components, and careful layout of the system are mandatory. The plasma display panel itself may have to meet more rigorous standards. All this leads to higher product cost, and less flexibility in making system trade-offs.

In addition, a 1024×1024 panel could not be driven by these driver chips, since such a panel would draw approximately 40 mA from each IC, increasing the voltage notch. Therefore, these chips are limited to driving a panel no larger than a 512×512 size.

There is also a logic error in the SN75501 driver chip. The chip is switched from its low output to its high output by a current booster (responsible for the boost current power dissipation problem described above). This current booster is essentially a bi-level current source. When the driver chip output is in its low state, 10 microamps are supplied. When a logic signal indicates the driver chip is to go high, the current booster supplies a 2 mA boost current, causing the pull-up output transistor to be driven on.

The logic error occurs when the strobe input pin of the chip (used for the address pulse input) is held low and the sustain pin (used for the distributed conditioning input) is brought high. This logic state should cause the driver output to quickly go to its high state. The boost current, however, is not applied, and the output is a slowly rising ramp, taking 5 to 10 microseconds to reach the high state.

Since an operation on the panel may take less than the 5 to 10 microsecond rise time of the pulse, it is not of any use in addressing the panel. In the past, systems have been designed around this flaw resulting in inefficient and inconvenient operations being necessitated.

SUMMARY OF THE INVENTION

In order to understand the operation of the present invention, a brief description of the operation of a typical plasma panel system and its sustain and drive circuitry is necessary. There are four control functions that are used to operate an AC plasma panel: the write function, the erase function, the sustain function, and the bulk-erase function. The write function causes a selected cell on the panel to be changed from the "off", or non-light emitting state, to the "on", or light emitting state. The sustain function maintains the state of all cells in the panel, i.e., causes "on" cells to remain on, and "off" cells to remain off. The sustain function also causes the "on" cells to emit light. The erase function causes a selected cell to be changed from the "on" state to the "off" state. The bulk-erase function causes all "on" cells in the panel simultaneously to be changed to the "off" state.

Operation of the four control functions is generally controlled by four logic signals: the X-sustain signal XS, the Y-sustain signal YS, the X-Address Pulse XAP and the Y-Address Pulse YAP. These signals, generally supplied by a waveform ROM (Read Only Memory), are digital pulse trains typically operating at a frequency of 50 kHz. The logic signals are supplied to the sustain and drive circuits, and cause these circuits to execute the four control functions on the panel.

The driver chips are used to drive the electrodes in the plasma panel. Voltages supplied to the electrodes are of two types: sustaining and pulsing. The sustain voltages perform the sustain function described above. The pulsed voltages are used to write, or turn cells "on", and to erase, or turn cells "off". It is during the switching operation that the pulsed voltages are generated, and the problems described above occur. The driver chips supply these pulsed voltages only to the cells to be written or erased. This selective supplying is the second function of the driver chips.

The present invention solves the problems inherent in the driver chips by adding to the circuitry two voltage pulser circuits, one for the X-axis, and one for the Y-axis. The pulser circuits are inserted between the sustain circuits and the drive circuits. The Y-voltage pulser circuit provides a positive pulse, and the X-voltage pulser circuit provides a negative pulse.

The voltage pulser circuits are used to turn the high voltage level supplied to the electrodes by the driver chips on and off, this high voltage level being turned off whenever the driver chips are not performing an addressing function, i.e., a write or erase function. The high level voltage is turned off by connecting the high level input of the driver chips to the ground input of the driver chips.

For normal sustain operation and during the time in write and erase operations when a pulsed voltage is not to be sent to the electrodes, the voltage pulser circuit connects the driver chip ground lead to the high voltage input lead. This has the effect of shorting the parasitic np and pn junctions, as well as the totem-pole output transistors, making the chip circuitry appear to be a small resistance in series with two parallel diodes, the diodes connected in reverse polarity. The most obvious advantage is that the parasitic transistors are completely eliminated, and with them goes the problem of excessive power dissipation in the parasitic transistors.

A second effect of short circuiting the floating ground and the high voltage input of the driver chips is to eliminate notch dissipation power in the totem-pole output stage of these chips by shorting the output transistors. Since the high voltage potential is no longer applied to the circuitry of the chips during sustain operation, quiescent power dissipation is no longer a problem. Therefore, it can be seen that quiescent power, parasitic power, and notch dissipation power are eliminated during the sustain operation and the non-addressing portions of the write and erase operations, which generally are the bulk of the time the panel is in operation.

The level shifting boost power is also eliminated during sustain operation by the short circuit action of the voltage pulser circuitry. Since a separate sustainer circuit is used to provide the sustaining voltage input to the floating ground of the driver chips, the boost current generator is no longer used to perform this operation. Such a separate sustainer circuit is disclosed in copending patent application entitled "MOSFET Sustainer Circuit For An AC Plasma Display Panel", referenced below.

The low voltage logic power, which is a fairly negligible amount, remains as the only one of the five power components of the driver chips which is not eliminated or reduced by the present invention. Therefore, it can be seen that the present invention eliminates most of the power which the driver chips were required to dissipate in earlier applications. The benefits of the present invention are made more apparent by the fact that the temperature rise in the chips caused by power dissipation with the use of the present invention is only a 3° to 5° C. rise over the ambient temperature, compared to a 75° C. increase without the present invention. By utilizing the present invention, the early burn-out problem of the Texas Instruments driver chips is substantially eliminated.

The voltage pulser circuit utilizes the MOSFET sustainer of the Weber application incorporated by reference above, but applies that circuit to a new use as a pulser circuit. The fast fall time of the driver chips which resulted in system noise generation is no longer a problem because the Weber sustainer used for the voltage pulser circuitryh resulted in system noise generation is no longer a problem because the Weber sustainer used for the voltage pulser circuitry has a slew rate control which is utilized to prevent the fast fall time inherent in the Texas Instruments chips. Since the voltage pulser circuit is supplying the high voltage level to the driver chips, by having the voltage pulser circuit go to its low state, the slew rate of the transition being controlled, the voltage supplied by the driver chips will fall only as fast as the slew rate controlled falling voltage of the voltage pulser circuitry.

The shorting of the ground pin and the high voltage pin of the driver chips during the sustain operation also has the effect of eliminating the problem of lowered voltage supplied to the electrodes because of the voltage notch. Since the driver chips totem-pole-output stages are shorted, the voltage drop developed across these transistors is now limited to only a diode voltage drop, approximately 0.7 volts, as contrasted with up to 8.5 volts with the earlier system. During the time addressing pulses are being generated, the ground pin and the high voltage pin of the driver chips will not be shorted. Since the high voltage input is supplied by the voltage pulser circuit, the slew rate control will prevent the high current levels which caused the voltage notch. There will be some degree of voltage notch, but much less than that experienced without the voltage pulser circuit.

Since the voltage notch is reduced, less precise regulation of the power supply, less precise components, and more flexibility in system layout are permitted. Lower product cost will also result.

Lowering of the notch voltage also has another important implication. The present invention would allow the Texas Instruments driver chips to be used to drive a 1024×1024 plasma panel, a significant step forward since the larger panel allows much more flexibility in creating graphic displays.

The final design defect of the Texas Instruments driver chips is the internal logic error, which is solved by utilizing the voltage pulser circuit to bring the voltage output of the driver chip high. When a write function is to be performed on the plasma panel, the sustain pin (used for the distributed conditioning input) is brought high and the strobe pin (used for the address pulse input) is brought low, before the voltage pulser goes to its high state. By doing this, the output of the driver chip will simply follow the high voltage input from the voltage pulser circuit. The logic error is bypassed in this manner.

Further advantages of the present invention include the provision for expansion to include operating modes and features which may be developed in the future. Should another manufacturer design and build a driver chip, that driver chip may well have operational characteristics different from the Texas Instruments driver chips. The drive electronics improvements of this invention provide transparency to these different characteristics.

RELATED APPLICATIONS

This specification is one of a group of specifications on plasma display technology, all assigned to the present assignee, including: System For Driving AC Plasma Panel, Ser. No. 412,205, filed Aug. 27, 1982, which is a continuation of Ser. No. 166,579, filed July 7, 1980 (now abandoned), by Joseph T. Suste; MOSFET Sustainer Circuit For An AC Plasma Display Panel, Ser. No. 258,757, filed Apr. 29, 1981, by Larry F. Weber; Constant Data Rate Brightness Control For An AC Plasma Panel, Ser. No. 273,095, filed June 12, 1981, by Joseph T. Suste; Distributed Conditioning For An AC Plasma Panel, Ser. No. 273,093, filed June 12, 1981, by Michael J. Marentic and Joseph T. Suste; Modular Waveform Generator For Plasma Display Panels, Ser. No. 273,092, filed June 12, 1981, by Michael J. Marentic and Daniel A. Manseau; Advanced Waveform Techniques For Plasma Display Panel, Ser. No. 273,094, filed June 12, 1981, by Michael J. Marentic.

DESCRIPTION OF THE DRAWINGS

These and other advantages of the present invention are best understood through reference to the drawings, in which:

FIG. 3 shows the logic error inherent in the Texas Instruments driver chips of FIG. 2, and the logic input to the pins of the chips which will cause the error;

FIG. 4 is a block diagram of a plasma display panel and its sustain and drive circuitry, containing the present invention;

FIG. 8A is a schematic diagram of a single output stage of the Texas Instruments driver chip as Texas Instruments intended it to be implemented;

FIG. 8B is a schematic diagram of a single output stage of a Texas Instruments driver chip as it was actually integrated;

FIG. 8C is a schematic diagram of a single output stage of a Texas Instruments driver chip with the voltage pulser circuit of the present invention being used to short the ground and high voltage inputs of the driver chip;

DETAILED DESCRIPTION OF THE PREFERRED EMBODIMENT

Figure 1:
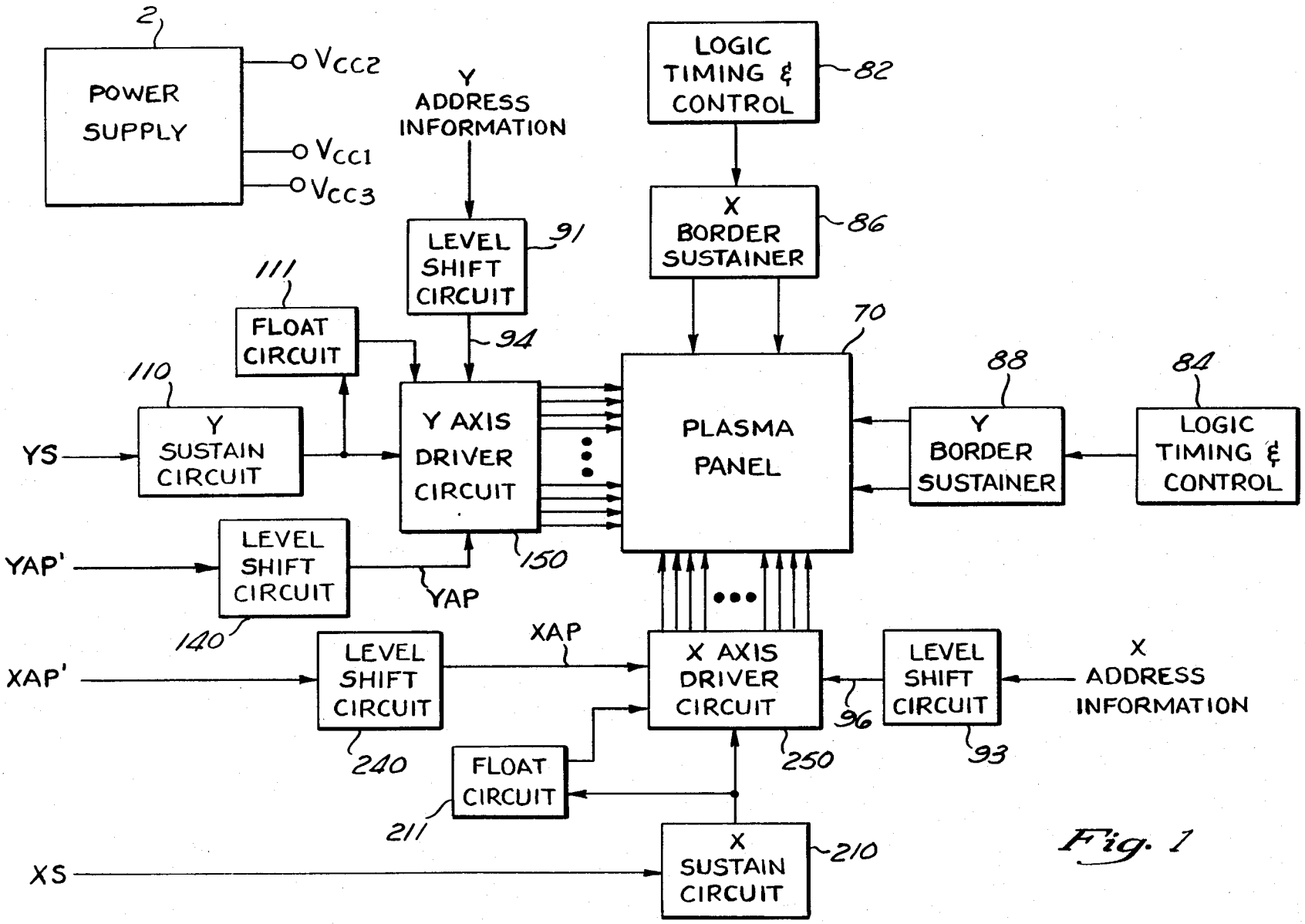
FIG. 1 is a block diagram of a typical plasma display panel and its drive and sustain electronics.

A plasma panel 70, as shown in FIG. 1, is driven by an X-axis driver circuit 250 and a Y-axis driver circuit 150. A general description of the circuitry of FIG. 1 is provided below, to aid in the understanding of the present invention.

A pair of sustain circuits 210 and 110 are used to provide the sustain signal to the driver circuits 250 and 150, respectively. Alternatively, many prior art plasma display driver circuits utilize an inherent sustaining capability of the Texas Instruments driver chips SN75501, and thereby eliminate the sustain circuit 210. Float circuits 211 and 111 are used to supply floating supply levels of $V_{CC1}$, the low voltage used to power the logic circuitry, and $V_{CC2}$, the high voltage used to drive the panel, to the circuits 250 and 150, respectively. The X-axis sustain circuit 210 is controlled by an X-sustain signal XS, and the Y-axis sustain circuit is controlled by a Y-sustain signal YS. The addressing of individual cells of the panel 70, to accomplish selective writing and erasing of these cells, is controlled by an X-address pulse XAP and a Y-address pulse YAP, supplied from a waveform ROM (Read Only Memory, not shown) through a pair of level shift circuits 240 and 140, which are required, since the driver circuits 250 and 150 operate on floating grounds. The X-address information and Y-address information is supplied to the driver circuits 250 and 150 through a pair of level shift circuits 93 and 91, respectively, and identifies which cells on the plasma panel 70 are to receive the X and Y address pulses.

The X-border sustainer 86 and the Y-border sustainer 88, and their logic timing and controls 82 and 84, respectively, are used to provide sufficient free particles so that write operations can be carried out with complete accuracy.

Figure 2:
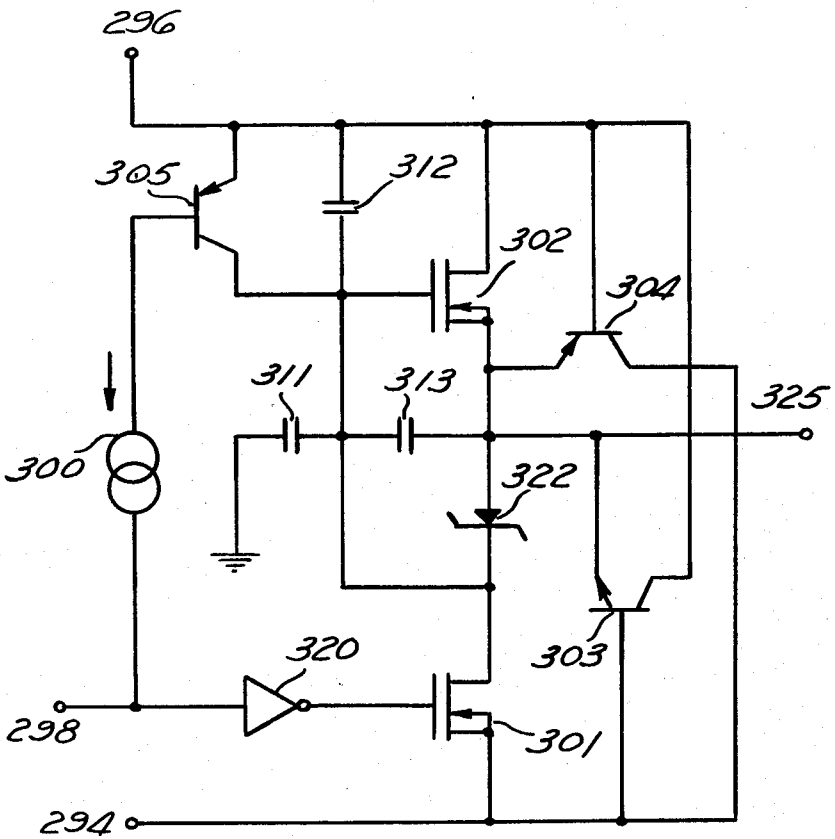
FIG. 2 is a schematic diagram of the switching circuitry for a single output of the Texas Instruments driver chips, used in the driver circuits of FIG. 1.

FIG. 2 shows the schematic diagram for a single output stage in a Texas Instruments driver chip used in the driver circuits 250,150 (FIG. 1) to drive the electrodes in the plasma panel 70. A totem-pole output stage is designed with two DMOS transistors, pull-down transistor 301 and pull-up transistor 302. For a sustain function, pull-down transistor 301 will be turned on, so that the output 325 will be supplied the voltage level of the output from a sustain circuit, supplied to terminal 294. To address a cell, the logic signal input at 298 will go from 0 to 1, and will cause the pull-down transistor 301 to turn off and the pull-up transistor 302 to turn on. When pull-up transistor 302 is on, the output 325 is connected to terminal 296, which is the high voltage input of the driver chip. Capacitors 311, 312, and 313, an inverter 320, and a Zener diode 322 are used to properly bias and operate the system. A transistor 305 and a current source 300 are used to switch from the low output to the high output. The current source 300 is a bi-level current source, triggered by the logic input 298. The normal current supplied by the current source 300 is 10 microamps, but when the logic input 298 indicates that the circuit is to switch to the high level, the current is boosted to 2 mA for 600 nS. The effect of this boosted current is to turn the transistor 302 on fairly quickly, but at a fairly large cost in terms of power dissipation.

The SN75501 chip has a logic error which will result in this boost current not to be applied to the output stage for certain combinations of the sustain pin (used for a distributed conditioning input) and the strobe pin (used for the addressing input). These pins, not shown in the drawings, are inputs to the driver chip, and are described in Texas Instruments data books. FIG. 3 shows the sequencing of the logic inputs to the sustain and strobe pins of the driver chip, and the output which will result. It can be seen that when the strobe is high at a time when a sustain pulse is applied, the boost current is properly applied and the output will be the desired square wave. However, if the strobe is held low, and the sustain is brought high, the boost current is not applied, and the output is a rising ramp rather than a square wave. Since the rise time, which varies from chip to chip, is typically 5 to 10 microseconds, and an operation performed on the panel may take well less time than 2 microseconds, the pulse will not reach its peak while the operation is being performed. The result is an operation which does not properly perform the function.

The present invention solves the above-described problems by controlling the supply of high level voltage to the driver chips contained in driver circuits 250,150 (FIG. 1). The driver chips, Texas Instruments SN75500 and SN75501, utilize the high voltage supplied to them only when pulsing during write and erase operations. A detailed description of the pulsing operation used to perform write and erase operations is contained in the above-referenced application entitled "Constant Data Rate Brightness Control For An AC Plasma Panel", and that specification is hereby incorporated by reference herein.

The present invention removes the high voltage level from the high voltage input lead 296 of the driver chips, and ties this high voltage input lead of the driver chips to the ground lead 294 of the driver chips. By controlling the times when high voltage is supplied to the driver chips, addressing operations can still be performed. During all times when the high voltage pulse is not required to perform a write or erase operation, the high voltage input of the chips will be tied to the ground of the chip. By tying these two inputs together, most of the power dissipation problems of the chip are eliminated. The manner in which the other problems inherent in the driver chips are eliminated will become apparent later in the specification.

The operation of switching the high voltage input to the driver chips on and off and grounding the high voltage input of the chips to the ground of the chips when the high voltage input is turned off is performed by voltage pulser circuits. These voltage pulser circuits are of the dual MOSFET sustainer type, as described in the above-referenced and incorporated application entitled "MOSFET Sustainer For A Plasma Panel Drive System".

FIG. 4 shows the voltage pulser circuits 170,270 of the present invention installed into the circuit of FIG. 1. Float circuits 213, 215, and 111 are used to supply the voltage pulser circuits 170,270 with floating levels of $V_{CC1}$ and $V_{CC2}$, and also to supply the driver circuits 150,250 with floating $V_{CC1}$ power.

The voltage pulser circuits are controlled by two logic signals, the X-Address Pulse to Pulser XAPP and the Y-Address Pulse to Pulser YAPP. These pulses are supplied via level shift circuits 141,241. The address pulses supplied to the driver circuits 150,250 are now labeled Y-Address Pulse to Driver YAPD and X-Address Pulse to Driver XAPD; these pulses perform the same functions they performed in the circuit of FIG. 1.

Figure 5:
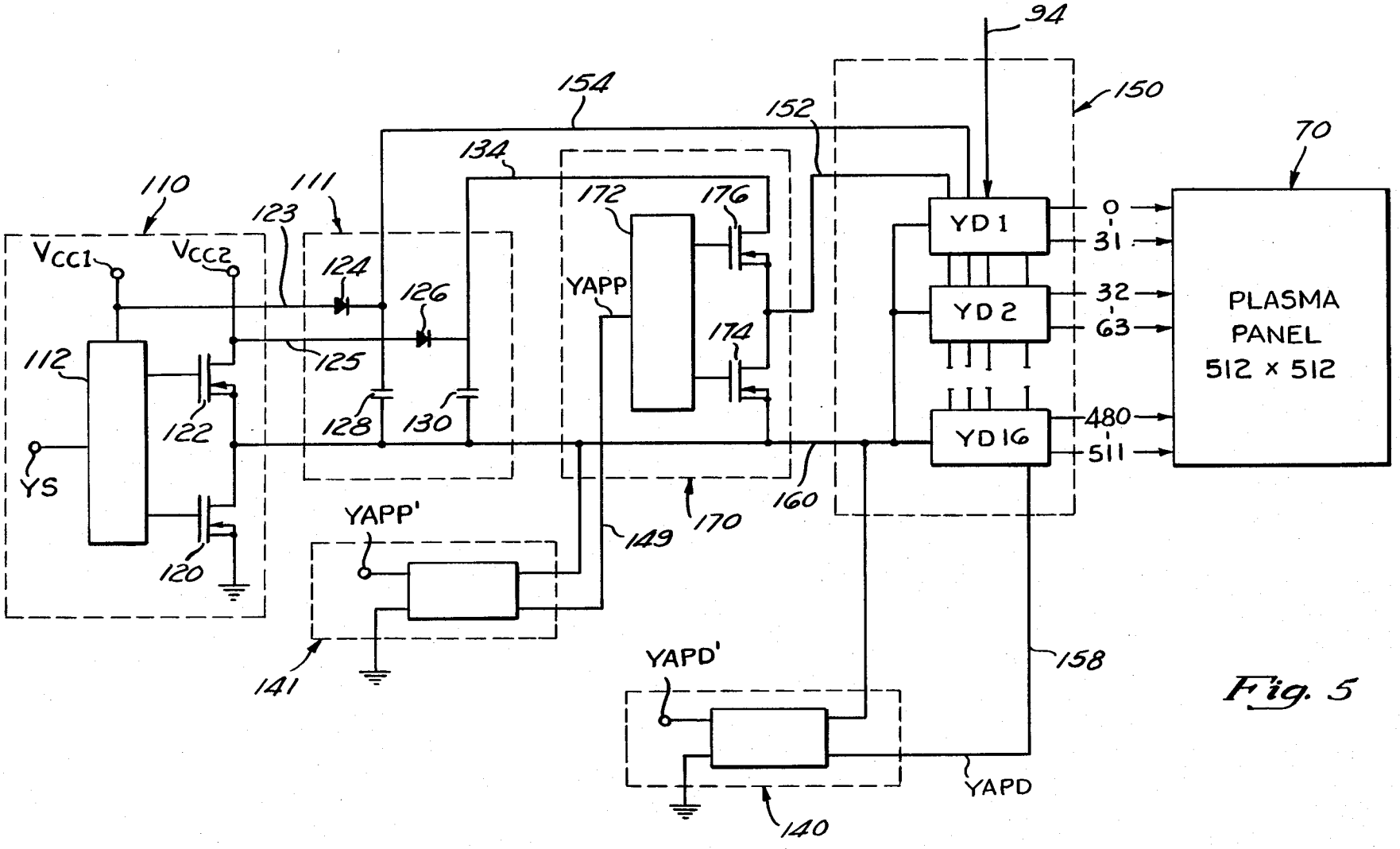
FIG. 5 is a schematic diagram of the Y-axis sustain, voltage pulser, and driver circuitry for the circuit shown in FIG. 4.

FIG. 5 is a schematic diagram of the Y-sustain circuit 110, the Y-voltage pulser circuit 170, and the Y-axis driver circuit 150, with the various components of FIG. 4 shown in dotted lines in FIG. 5. The Y-sustain circuit 110, the float circuit 111, and the level shift 140 operate as they have in circuits not utilizing the voltage pulser circuit 170. For a further description of these circuits, see the above-incorporated application entitled "Constant Data Rate Brightness Control For An AC Plasma Panel".

The high voltage output of the float circuit 111 is on line 134. This high level voltage was supplied directly to the driver chips on line 152 in applications not using the voltage pulser circuit 170 (FIG. 1). The voltage pulser circuit 170 acts to control switching of the high level voltage on line 134 to the driver chips on line 152.

When YAPP is at a logic level of 1, the control circuitry 172 will cause the pull-up transistor 176 to connect the high voltage supplied on line 134 to the positive voltage input of the circuit 150 on line 152 and will cause the pull-down transistor 174 to be non-conductive. When YAPP is at a logic level of 0, the control circuitry 172 will cause the pull-down transistor 174 to be conductive, and the pull-up transistor 176 to be non-conductive, switching off the high voltage supplied by the line 134 and connecting the positive voltage input 152 of the driver circuit 150 to the floating ground 160, which is the ground input for the driver circuit 150. This later condition exists during sustain operations, when YAPP will be at a logic level of 0, so the high voltage will not be supplied to the driver chips. Even during write or erase operations, the high voltage will not be supplied to the driver chips during the entire function; rather, the high voltage will be supplied to the driver chips only during the actual time that a pulsing operation utilizing this high voltage is occurring. In this way, it can be seen that the Y-voltage pulser circuit 170 is itself performing the pulsing operation which the Y driver chips performed in earlier applications. Since the transistors 176,174 in the Y-voltage pulser circuit 170 need not meet the same constraints imposed upon Texas Instruments in the development of their integrated circuit, and because these transistors are outside of the case of the driver 150, they do not have any power dissipation problems. Thus, the addition of the voltage pulser circuit 170 will not adversely affect the system in any way.

Figure 6:
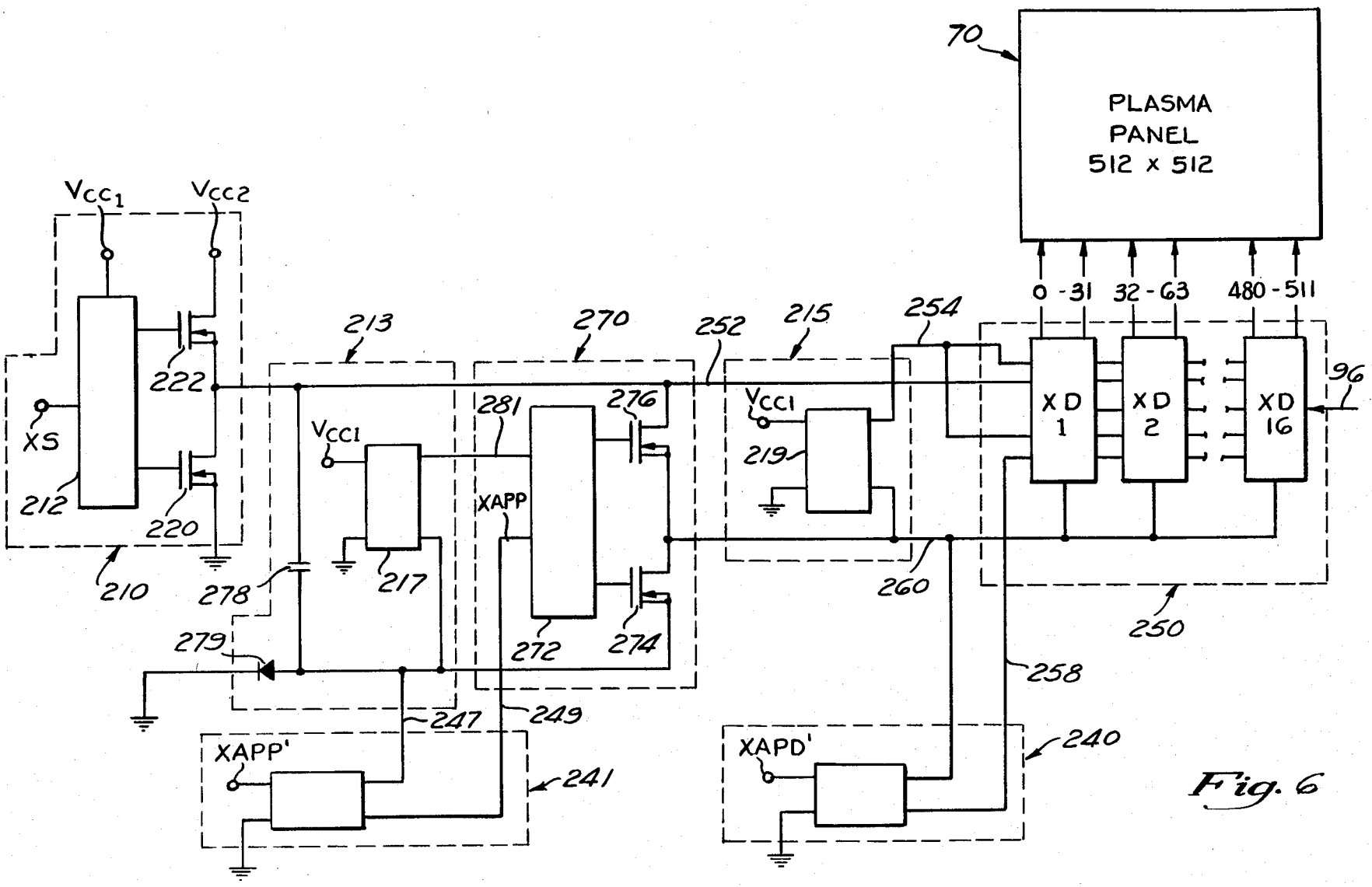
FIG. 6. is a schematic diagram of the X-axis sustain, voltage pulser, and driver circuitry for the circuit shown is FIG. 4.

The circuitry controlling the X-axis driver 250 is shown in FIG. 6, and it differs from that of the Y-axis circuitry in that the X-axis driver circuit 250 includes SN75501 driver chips, which are designed for negative pulsing. In negative pulsing, instead of adding a pulse on top of the sustainer waveform in order to address the panel, a voltage is subtracted from the sustainer waveform. The X-sustainer 210 is exactly the same as the Y-sustainer, and it functions in the same manner.

A float circuit 213 is used to supply the X-voltage pulser circuit 270 with a floating $V_{CC1}$, and to supply the pull-down transistor 274 with the floating $-V_{CC2}$ voltage level. The $-V_{CC2}$ floating voltage is supplied by a capacitor 278 and a diode 279 to line 247. The floating $V_{CC1}$ is referenced to line 247, and is supplied to the X-voltage pulser circuit 270 on line 281 by a converter 217, which will be described in detail below. A second float circuit 215 is used to supply the driver circuit 250 with a floating $V_{CC1}$ on line 254 with reference to line 260. This second float circuit 215 contains a converter 219 which is identical to the converter 217.

Figure 7:
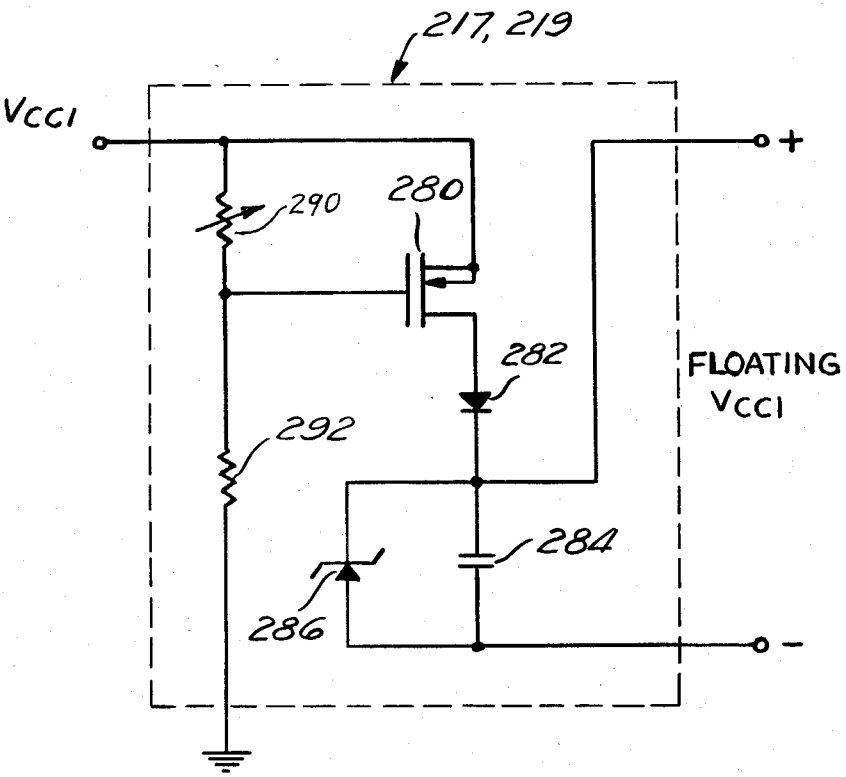
FIG. 7 is a schematic diagram of the circuit for deriving a floating $V_{CC1}$ from a ground-based $V_{CC1}$ power supply shown in FIGS. 5 and 6.

A schematic for this converter is shown in FIG. 7. Resistors 290 and 292 are used to bias an FET 280, one of the resistors 290 being variable. Additional components of the circuit are a diode 282, a Zener diode 286, and a capacitor 284. The FET 280 acts as a constant current source and will therefore be adjustable by the resistors 290 and 292. The voltage supplied at the outputs is floating with respect to the grounded $V_{CC1}$ input. Although this circuit is the preferred embodiment, any circuit which will supply a floating level of $V_{CC1}$ is acceptable.

The operation of the X-voltage pulser circuit 270, shown in FIG. 6, is much the same as the operation of the Y-voltage pulser circuit 170 described above. However, since the X-axis circuitry is designed for negative pulsing, when the pull-down transistor 274 is conductive, and the pull-up transistor 276 is non-conductive, line 260, the negative voltage input of the driver chips (supplied to the ground input of the chips), is supplied with the voltage level $V_{CC2}$ lower than the level on line 252, the floating ground of the driver chips (supplied to the high voltage input pin of the chips). This $-V_{CC2}$ is applied only during the addressing operation. The pull-up transistor 276 is rendered conductive, and the transistor 274 non-conductive, except when address pulses are needed during an erase or write operation. When XAPP is at a logic level of 1, the transistor 276 will short the negative voltage input 260 and the floating ground 252 of the driver chips. When XAPP is at a logic level of zero, the pull-down transistor 274 will impress a $-V_{CC2}$ pulse on the sustain signal, to be used for write and erase operations.

Therefore, for both the X and Y axis driver circuits, 250, 150, during operation of the system when voltage pulses are not needed, the negative voltage input 260 and the floating ground 252 to the X-driver circuit 250 will be shorted together by the X-voltage pulser circuit 270, and the positive voltage input 152 and the floating ground 160 to the Y-driver circuit 150 will be shorted together by the Y-voltage pulser circuit 170.

Referring again to FIG. 2, two parasitic transistors 303 and 304 are shown. The desired circuit for the Texas Instruments driver chips includes a pair of clamp diodes, which are shown in FIG. 8A as D303 and D304. The diode D303 would prevent the output from falling lower than the level of the negative voltage input 260, which was connected to terminal 294. The diode D304 functions to prevent the output 325 from rising to a level higher than that of the floating ground input 252, which is connected to terminal 296. In the process of fabricating the diodes D303 and D304, the parasitic bipolar transistors 303 and 304, shown in FIG. 8B, were created. The present invention connects the high voltage chip input 296 to the ground input 294, when the system is not pulsing, so that the circuit shown in FIG. 8C is the net result. The terminals 294 and 296, connected together, are shown as the terminal 295 in FIG. 8C. These terminals 294, 296 are shorted, as described above, by the pull-down transistor 174 of the Y-voltage pulser circuit 170 (FIG. 5), or by the pull-up transistor 276 of the X-voltage pulser circuit 270 (FIG. 6). The resulting circuit of FIG. 8C has a resistance 308, representing the inherent resistance of the diodes D303, D304, connected in series with a pair of ideal diodes, which are connected in parallel, in reverse polarity. These diodes are the diodes D303 and D304, desired in the Texas Instruments chip. The other junctions of the transistors 303 and 304, shown in FIG. 8B, are eliminated from the circuit, because they are shorted out by the shorting of terminals 294 and 296. Therefore, power dissipation problems of the parasitic transistors are completely eliminated except during the relatively short period of time that address pulses are being generated.

A second problem which is solved by shorting the terminals 294 and 296 together is the elimination of the notch dissipation power during the time the circuit is not pulsing. During this time, there is no longer a voltage drop across the pull-up and pull-down transistors 301, 302 in the integrated circuit chip. Even when the circuit is pulsing during a write or erase operation, the voltage pulse has a maximum slew rate determined by the voltage pulser circuits 170, 270. Since this slew rate control will limit the amount of current flowing through the transistors 301, 302 in the driver chip, the voltage drop across these transistors is substantially reduced.

Since the high voltage input and the ground of the driver chips are shorted during all operations other than when a pulse for an erase or write function is occurring, the system will draw no quiescent power. Since this power is not drawn by the chip, it does not have to be dissipated within the chip. In addition, since circuitry external from the chip is performing the sustain and pulse operations, the number of times that the high level boost current of the current generator 300 (FIG. 2) would be required are greatly reduced, thus greatly reducing the level shifting boost power which would normally have to be dissipated within the chip.

Therefore, during sustain operation and non-pulsing portions of write and erase operations, the only power dissipated by the chip is low voltage logic power. Therefore, even if the system is operating in a 100% addressing rate, the only time when power will be dissipated by the chip is during the actual pulsing period, which is approximately 10% of the overall time. Therefore, approximately 90% of the power dissipated in the chip is eliminated.

Figure 9:
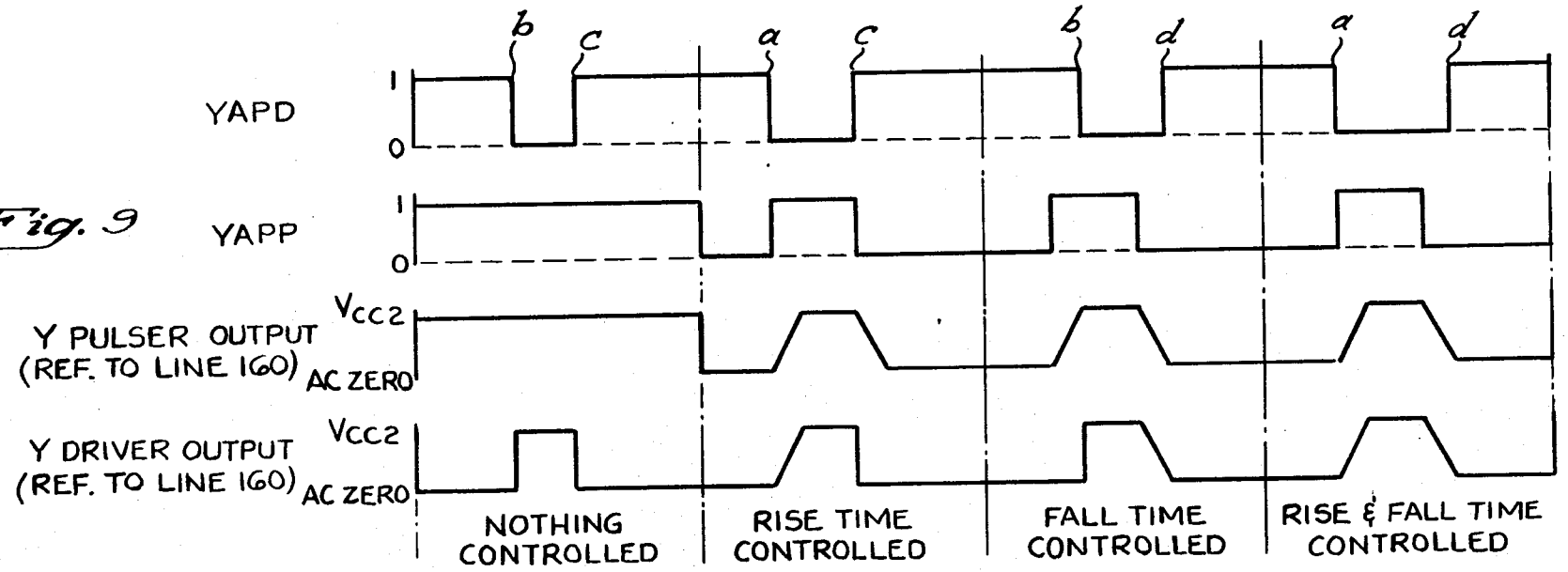
FIG. 9 is a waveform diagram showing the rise and fall times of the Y-driver output shown in FIG. 5 as controlled by the Y-pulser output and the logic control signals YAPD and YAPP.
Figure 10:
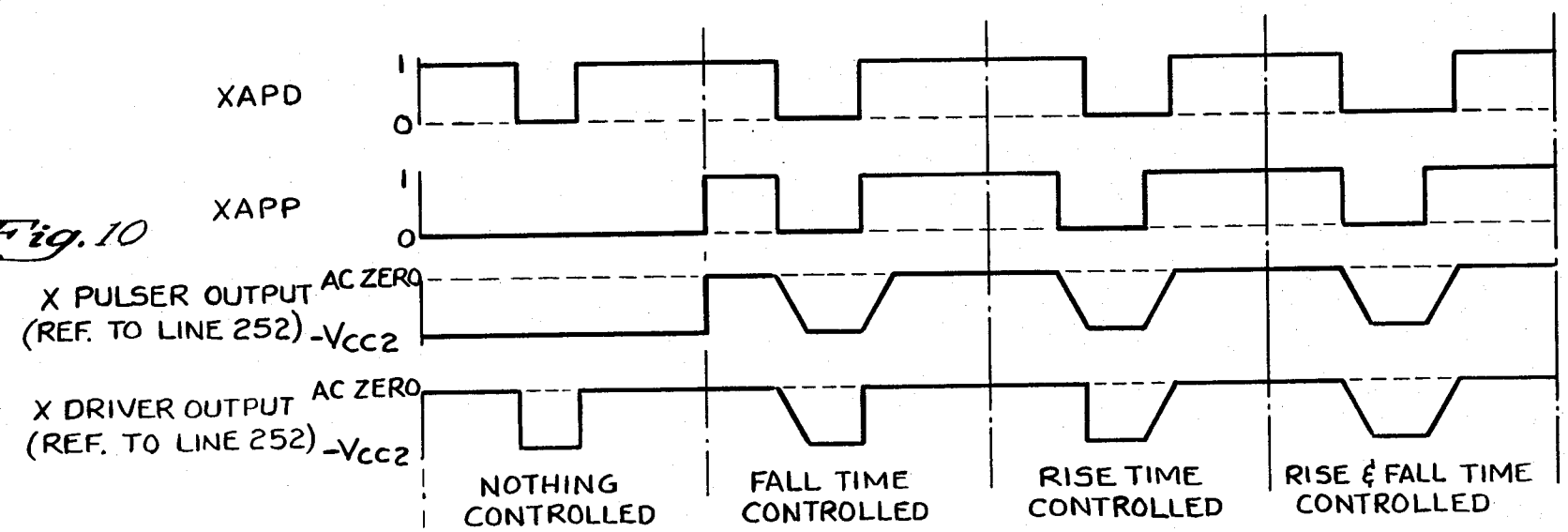
FIG. 10 is a waveform diagram showing rise and fall times of the X-driver output shown in FIG. 6 as controlled by the X-pulser output and the logic control signals XAPD and XAPP.

The method of eliminating the fast fall time of the driver chip output and the resulting system noise generation is shown in FIG. 9 for the Y-axis circuitry, and in FIG. 10 for the X-axis circuitry.

A description for the Y-axis circuitry is as follows. FIG. 9 shows the possible ways in which the slew rate control of the voltage pulser can be utilized to control rise time and/or fall time. The first example, controlling neither rise nor fall time, is undesirable because of the fast fall time of the chips. The second example shows how rise time may be controlled. The third example shows how to control fall time, and is a solution to the fast fall time of the driver chips. The final example controls both rise and fall time, and also eliminates the problem of fast fall time in the chips. The system of the present invention, therefore, presents a high degree of flexibility in that both rise and/or fall time may be controlled.

The voltage pulser 170 is used to generate the addressing pulse (Y-pulser output). The YAPP signal shown causes the Y-pulser output voltage to be generated. By supplying the appropriate YAPD logic signal, the output of the Y driver circuit will control the rise time, the fall time, or both the rise and fall time of the driver output voltage, as described above, which is conducted to the Y-electrodes on the plasma panel 70. By making the YAPD logic signal go low at points a either before, or simultaneously with the occurrence of YAPP going high, the driver output will follow the rising ramp of the voltage pulser output. On the other hand, by making the YAPD logic signals go low at points b, after YAPP has gone high, the rise time is not controlled by the voltage pulser circuit, but rather by the driver circuit.

The fall time may be controlled in a similar manner. By allowing the YAPD logic signal to return to the high state at the points indicated by c, either before or simultaneously with the YAPP going low, the fall time is not controlled by the voltage pulser circuit, and is allowed to fall as rapidly as the driver circuit allows. However, by having the YAPD logic signal remain low until the points indicated by d, after YAPP has gone low, the driver output will follow the pulser output, thus controlling the fall time of the pulse. The X-axis circuitry operates in a similar manner, as shown by FIG. 10. In this way, the rise time and fall time may be controlled, and problems associated with the fast fall time of the driver chips are eliminated by allowing the voltage pulser circuits to use their inherent slew rate control circuitry to control the slew rate of the driver output voltage.

Figure 11:
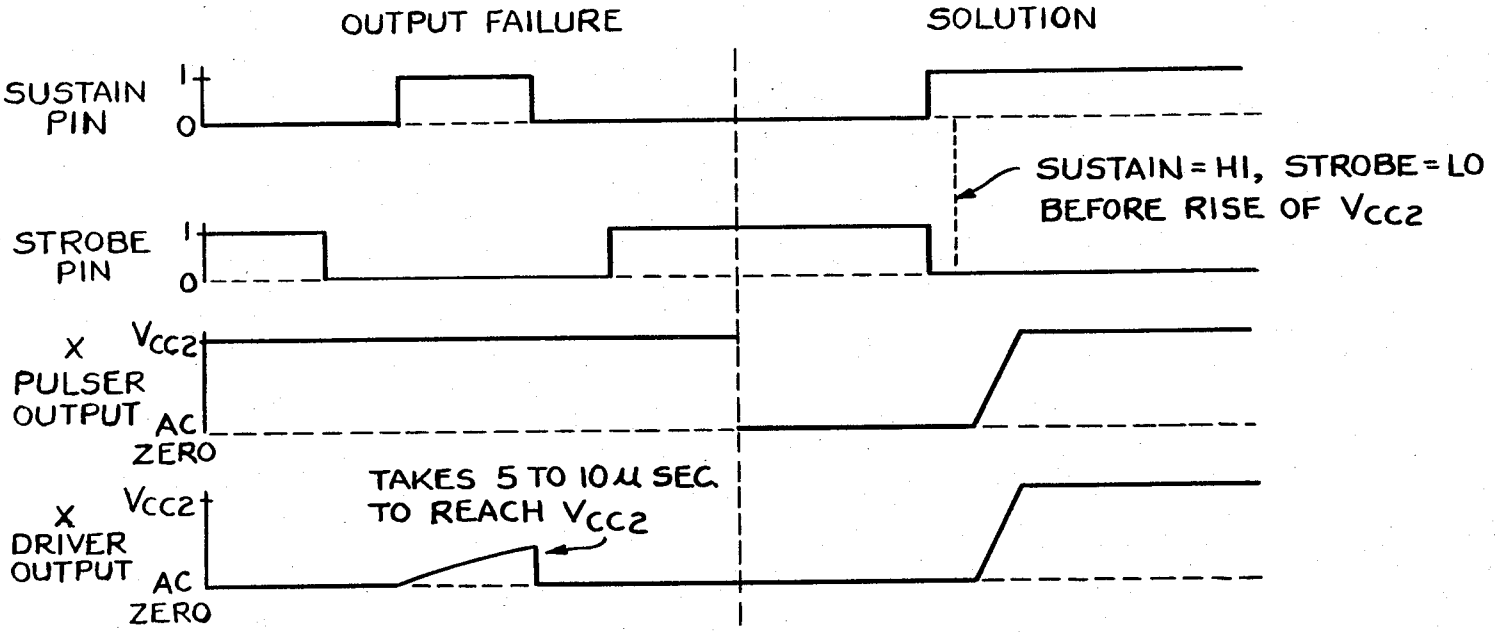
FIG. 11 is a waveform diagram showing the logic failure of FIG. 3, and the manner in which it is remedied utilizing the present invention.

The solution to the logic error is shown in FIG. 11, and is similar to the rise and fall time solution just discussed. The left side of FIG. 11 shows the output failure, and the right side shows the solution. The logic signals shown in FIG. 11 are applied to the sustain pin (not shown) and the strobe pin (not shown) of the driver chip. The solution is provided by performing the pulsing operation with the voltage pulser circuit 270. By bringing the sustain pin high some period of time before the pulse is to occur, the driver chip will simply follow the X-pulser output. Therefore, it can be seen that the solution to the logic error is to bring the input to the sustain pin of the SN75501 chip high a sufficient period of time in advance of the rise of the X-voltage pulser circuit 270 output voltage.

The notch voltage drop across the output transistors 301,302 (FIG. 2) of the driver chips is also eliminated during the sustain function and non-pulsing portions of the write and erase functions, since transistors 301 and 302 are shorted by the voltage pulser circuits 170, 270 (FIGS. 5 and 6) during these operations. The only voltage notch which will appear is the voltage drop across the diodes D303 and D304 (FIG. 8C), illustrated by the resistor 308.

The voltage notch during the time that addressing pulses are being performed is also considerably smaller, as mentioned above, because the voltage pulser circuits 170, 270 include slew rate controls. The slew rate controls will limit the amount of current, thus resulting in lower voltage drops across the transistors 301, 302 (FIG. 2) during the pulsing function. Since the voltage notch is greatly reduced, the characteristics of the plasma display itself and the power supplies are not nearly as critical, and thus the overall cost of the plasma panel system may be reduced by using less precise components.

It can therefore be seen that the power dissipation problems of the Texas Instruments driver chips are virtually eliminated. Four of the five power dissipation factors, quiescent power, level shifting boost power, parasitic power, and notch dissipation power, are completely eliminated during the sustain operation and non-pulsing portions of the write and erase operations. This is illustrated by the fact that the temperature rise over ambient temperature is now only 3°-5° C. as compared to a 75° C. rise in a system not using voltage pulser circuits. The fast fall time inherent in the driver chips has been solved by using the slew rate control of the voltage pulsercircuits. The fast fall time inherent in the driver chips has been solved by using the slew rate control of the voltage pulser circuits. Therefore, generation of system noise is no longer a significant problem.

The notch voltage problem has been virtually eliminated, allowing plasma design engineers considerably more leeway in extending the versatility of plasma panel operations and in achieving lower system cost due to the use of less precise components. In addition, the elimination of the notch voltage allows a 1024×1024 plasma display panel to be driven. The logic error inherent in the design of the Texas Instruments driver chips has been eliminated by using the voltage pulser circuits to generate the output pulse used to address the panel.

What is claimed is:

1. A circuit for a plasma panel comprising:

an intergrated circuit comprising:

a first pair of transistors, connected in totem pole, between a first terminal and a second terminal, said pair of transistors alternatively conductive to alternatively connect an output line to said first terminal or to said second terminal;

a second pair of transistors, outside of said intergrated circuit, connected in totem pole between said first terminal and a voltage source, said second pair of transistors alternatively conductive to alternatively connect said second terminal to said first terminal or to said voltage source.

2. A circuit for a plasma panel as defined in claim 1 wherein said first pair of transistors provides a pulse, comprising:

means for controlling said second pair of transistors, said means causing said second pair of transistors to connect said second terminal to said first terminal except when said first pair of transistors is to supply a pulse to said panel.

3. A circuit for a plasma panel defined in claim 1 wherein said first pair of transistors provides a pulse, said circuit further comprising:

a pair of clamp diodes on said output of said first pair of transistors, said diodes functioning to keep the voltage level of said output of said first pair between the voltage level of said first terminal and the voltage level of said second terminal, said clamp diodes having an additional junction creating a parasitic transistor from each of said diodes; said parasitic transistors dissipating a high level of power when said second terminal is at a high voltage relative to the potential of said first terminal; and means for controlling said second pair of transistors, said means causing said second pair of transistors to connect said second terminal to said first terminal to short out said parasitic transistors when said first pair of transistors is not providing a pulse.

4. A circuit for a plasma panel as claimed in claim 1, wherein said second pair of transistors controls the rate at which the voltage applied to said second terminal rises and falls.

5. A circuit for a plasma panel including an integrated circuit which selectively connects a high voltage source to said panel, wherein said integrated circuit comprises a pair of transistors connected in totem pole, the circuit comprising:

a circuit connected between said voltage source and said integrated circuit for substantially eliminating power consumption by said integrated circuit except during said selective connection.

6. A circuit as defined in claim 5, wherein said circuit connected between said high voltage source and said integrated circuit additionally controls the rate of said selective connection of said voltage source to said panel.

7. A circuit as defined in claim 6, further comprising means for reducing voltage drops in said integrated circuit during said selective connection.

8. A circuit as defined in claim 5, further comprising means for reducing voltage drops in said integrated circuit during said selective connection.

9. A circuit for a plasma panel including an integrated circuit which selectively connects a high voltage source to said panel, comprising:

a circuit connected between said high voltage source and said integrated circuit for connecting the power input terminals of said integrated circuit together and thereby eliminating quiescent power consumption at selected times.

10. Apparatus for reducing the power consumption in an integrated driver circuit for an AC plasma panel, wherein the integrated circuit comprises a pair of transistors connected in totem pole, the apparatus comprising:

means for selectively disconnecting the power from said driver circuit; and means responsive to a stored complex waveform for controlling said disconnecting means.

11. A plasma panel drive system, comprising:

an integrated circuit for providing addressing and sustaining waveforms to said panel; and means for shorting power input terminals of said integrated circuit together at selected times to reduce the power consumption of said integrated circuit.

12. A method for operating a Texas Instruments SN75501 driver chip having a sustain pin, a strobe pin, and a high voltage input pin, comprising:

first, supplying a logic zero to said strobe pin and simultaneously supplying a logic one to said sustain pin;

second, supplying a high voltage pulse to said high voltage input pin at a predetermined time after said first step.

13. A method of controlling the generation of waveforms for an AC plasma panel, driven by driver chips, each having a low voltage input terminal and a high voltage input terminal, comprising:

generating a first group of waveforms controlling complex sustainer waveforms supplied to said panel;

generating a second group of waveforms controlling the high voltage supplied to said high voltage input terminals of said driver chips so that high voltage is supplied to said driver chips only when a write or erase pulse is to be supplied to said panel by said driver chips; and generating a third group of waveforms controlling said driver chips, so that said driver chips supply said high voltage to said panel to perform write or erase operations.

14. Control circuitry for an AC plasma panel, with cells, comprising:

first means for generating a sustainer signal to be supplied to said panel;

second means for transmitting said sustainer signal to said panel, said second means having a high voltage input so that when a high voltage is applied to said input said second means can selectively impress a pulse on said sustainer signal to perform a write or erase operation; and third means for connecting a high voltage to said high voltage input only when said write or erase operation requires said pulse.

15. A system for controlling the generation of waveforms for an AC plasma panel, driven by driver chips, each of which has a low voltage input terminal and a high voltage input terminal, comprising:

means for generating a first group of waveforms for controlling complex sustainer waveforms to be supplied to said panel;

means for generating a second group of waveforms for controlling the high voltage supplied to said high voltage input terminals of said driver chips only when a write or erase pulse is to be supplied to said panel by said driver chips; and means for generating a third group of waveforms for controlling said driver chips, so that said driver chips supply said high voltage to said panel to perform write or erase operations.

16. A circuit for a plasma panel including an integrated circuit which selectively connects a high voltage source to said panel, said circuit comprising:

a circuit connected between said high voltage source and said integrated circuit for connecting the power input terminals of said integrated circuit together except during said selective connection, thereby substantially eliminating power consumption by said integrated circuit except during said selective connection.

* * * * *